US008552244B1

(12) United States Patent
Wu et al.

(10) Patent No.: US 8,552,244 B1
(45) Date of Patent: Oct. 8, 2013

(54) PROCESS FOR RECOVERING SOLVENT FROM SPENT OIL SAND SOLIDS

(71) Applicant: Syncrude Canada Ltd. in trust for the owners of the Syncrude Project, Fort McMurray (CA)

(72) Inventors: Xin Alex Wu, Edmonton (CA); Sujit Bhattacharya, Edmonton (CA)

(73) Assignee: Syncrude Canada Ltd., Fort McMurray (CA), in trust for the owners of the Syncrude Project as such owners exist now and in the future ( * ) Notice: Subject to any disclaimer, the term of this patent is extended or adjusted under 35 U.S.C. 154(b) by 0 days.

(21) Appl. No.: 13/667,954

(22) Filed: Nov. 2, 2012

(51) Int. Cl.
*C07C 7/09* (2006.01)

(52) U.S. Cl.
USPC ..... 585/802; 208/390

(58) Field of Classification Search
None
See application file for complete search history.

(56) References Cited

U.S. PATENT DOCUMENTS

| | | | | |
|---|---|---|---|---|
| 3,475,318 | A | 10/1969 | Gable et al. | |
| 4,134,740 | A * | 1/1979 | Marion et al. | 48/197 R |
| 4,139,450 | A | 2/1979 | Hanson et al. | |
| 4,189,376 | A | 2/1980 | Mitchell | |
| 4,311,561 | A | 1/1982 | Hastings | |
| 4,347,118 | A | 8/1982 | Funk et al. | |
| 4,422,901 | A | 12/1983 | Karnofsky | |
| 4,448,667 | A | 5/1984 | Karnofsky | |
| 4,460,452 | A | 7/1984 | Johnson et al. | |
| 4,539,093 | A | 9/1985 | Friedman et al. | |
| 4,571,294 | A | 2/1986 | Friedman et al. | |
| 4,719,008 | A | 1/1988 | Sparks et al. | |
| 4,722,782 | A | 2/1988 | Graham et al. | |
| 4,968,412 | A | 11/1990 | Guymon | |
| 5,534,136 | A | 7/1996 | Rosenbloom | |
| 2009/0230025 | A1 * | 9/2009 | Argo et al. | 208/187 |
| 2009/0294332 | A1 | 12/2009 | Ryu | |
| 2012/0048782 | A1 | 3/2012 | Wu et al. | |

FOREIGN PATENT DOCUMENTS

| | | |
|---|---|---|
| CA | 2012563 | 9/1991 |
| CA | 2715301 | 3/2011 |
| CA | 2724806 | 6/2011 |
| CA | 2734067 | 9/2011 |

OTHER PUBLICATIONS

Kudra, T., et al. Superheated Steam Drying. Advanced Drying Technologies, 2nd Edition. 2009. Chapter 7. CRC Press. pp. 89-118.
Monceaux, D.A., et al. Dryhouse Technologies and DDGS Production. The Alcohol Textbook, 5th Edition. 2009. Chapter 21. Nottingham University Press. pp. 303-322.
Williams, M.A., et al. Recovery of Oils and Fats From Oilseeds and Fatty Materials. Bailey's Industrial Oil and Fat Products, 6th Edition. vol. 5 Edible Oil and Fat Products: Processing Technologies. 2005. Chapter 3. Wiley-Interscience. pp. 171-189.

* cited by examiner

*Primary Examiner* — Tam M Nguyen
(74) *Attorney, Agent, or Firm* — Bennett Jones LLP

(57) ABSTRACT

A process for recovering solvent from spent oil sands solids is provided, comprising drying the solids using superheated steam to vaporize solvent and water; compressing and condensing the vapors in a first heat exchanger (hot side) to produce condensates, comprising primarily condensed hot water, and uncondensed vapors; separating condensed hot water and solvent from the uncondensed vapors in a first separator; flowing the hot water through the first heat exchanger (cold side) to produce near-saturated steam; and superheating the near-saturated steam in a second heat exchanger to produce the superheated steam for drying the solids. Uncondensed vapors from the first separator can be further condensed in a third heat exchanger to produce warm water, recovered solvent and uncondensed off gas, which can be separated in a second separator. Some of the warm water is combined with the hot water to produce the near-saturated steam for superheating. The off gas is oil scrubbed or combusted prior to release to the atmosphere.

16 Claims, 2 Drawing Sheets

PROCESS FOR RECOVERING SOLVENT FROM SPENT OIL SAND SOLIDS

FIELD OF THE INVENTION

The present invention relates to a process for recovering hydrocarbon solvent from spent oil sand solids after oil sand bitumen has been extracted with the solvent.

BACKGROUND OF THE INVENTION

Extraction of bitumen from mined oil sands with hydrocarbon solvents uses little or no water, generates no wet tailings, and can achieve higher bitumen recovery than the existing Clark hot water extraction process or its variants. A problem which prevents solvent extraction processes from commercialization is the ineffective solvent recovery from spent oil sand solids. The problem becomes more challenging in large-scale oil sands operation, typically 8000 t/h of oil sands throughput per production train.

The prior art describes various methods for solvent recovery including, for example, water washing (see for example, U.S. Pat. Nos. 4,311,561 and 4,968,412); and saturated steam stripping using a filter bed, vertical column, rotary drum, or other vessels (see for example, U.S. Pat. Nos. 3,475,318; 4,189,376; 4,422,901; 4,448,667; 4,460,452; 4,719,008 and 4,722,782; and Canadian Patent Application No. 2,734,067). None of the prior art addresses the problem of solvent recovery from spent oil sand solids which contain 3-10 wt % water and 3-10 wt % solvent. Water washing generates undesirable wet tailings that negate the key benefit of using solvent extraction. Saturated steam stripping supplies heat to vaporize solvent by condensing steam and adding water to the solids. However, significant amounts of solvent remain trapped in solid lumps, which are apparently formed by water binding the solids through capillary pressure. The occluded solvent in solid lumps is difficult to recover. In commercial oil sand processing, solvent-laden spent solids are fed into a vertical desolventizer heated with steam jackets and live steam, and having multiple horizontal trays equipped with sweep arms for agitating solids (Williams, 2005). Such a complex design would be impractical and uneconomical in the oil sands industry.

Indirect drying processes in a rotary kiln, rotary dryer, or steam tuber dryer have been described (see for example, Canadian Patent Application No. 2,012,563; US Patent Application Publication No. 2009/0294332; U.S. Pat. No. 4,139,450). Such processes remove both water and solvent, thus disintegrate solid lumps during drying, thereby generating dry solids meeting environmental regulations for solvent content. The recovered solvent vapor and steam mixed with small amount of inert gas used as sweep gas can be condensed and recycled. However, the heat transfer coefficient for oil sand solids through heat conduction is at or less than about 60 $W/m^2K$, which makes the total heating surface area required for drying spent oil sand solids at 8000 t/h prohibitively large.

Direct drying using hot inert gas or flue gas in a fluid bed dryer, multi-hearth furnace and turbo dryer have been described (see for example, U.S. Pat. Nos. 4,347,118 and 5,534,136; Canadian Patent Application No. 2,715,301). Direct drying processes would produce similar low-solvent dry solids as when using indirect drying processes. Compared to indirect drying, direct drying allows more efficient heat exchanging and is amenable to handle a large solids throughput. However, hot flue gas or inert gas typically dilutes the solvent vapor, impeding solvent recovery.

Superheated solvent vapor drying has been described (see for example, U.S. Pat. Nos. 4,347,118 and 4,539,093). Since the heating medium is a condensable vapor, stripped solvent can be readily recovered; however, superheated solvent vapor is highly flammable and tends to coke and foul equipment. The same problem is present if any commercial superheated steam dryer is used directly for spent oil sand solids. These dryers recycle and superheat part of the produced vapors (Monceaux et al., 2009), which contain large amount of solvent vapors.

U.S. Pat. No. 4,571,294 describes a process using superheated steam to recover solvent. The used steam and produced vapors are condensed without being recycled, thus eliminating any fire hazard. The process applies to pelletized diatomaceous earth in which solvent would not be trapped within the pellets. The heat duty of solvent stripping is light. Therefore, a short-residence-time vertical column stripper was proposed in this invention. This process would be inadequate if it is used directly for spent oil sand solids, which trap solvent within the solid lumps and require significant drying (removal of water) for solvent recovery. A study showed that the water concentration must be decreased to 2 wt % or less (see for example, Canadian Patent Application No. 2,724,806) to reduce the solvent content in spent oil sand solids to an acceptable level.

Accordingly, there is a need for an improved method of recovering solvent from spent oil sand solids.

SUMMARY OF THE INVENTION

The current application is directed to a process for recovering solvent from spent oil sand solids. It was surprisingly discovered that by conducting the process of the present invention, one or more of the following benefits may be realized:

(1) Following use for drying spent oil sand solids, superheated steam undergoes a cycle of compression, condensation, decompression, re-vaporization, and superheating before being recycled for drying additional spent oil sand solids;

(2) The above cycle efficiently separates recovered solvent from condensed water and reuses the water to generate superheated steam with heat recovery. Heat is transferred from a high pressure system to a low pressure system through heat exchanging;

(3) The superheated steam is used to dry the oil sand solids at a high throughput;

(4) The solvent vapor in the steam can be readily recovered; and (5) Solvent recovery from the spent oil sand solids may be about 98% or greater.

Thus, use of the present invention provides a process of superheated steam drying, mechanical vapor recompression followed by two-stage cooling and condensation. A first separator produces primarily condensed water, while a second separator produces primarily condensed solvent. The two-stage cooling and condensation process conserves energy by condensing and recycling hot water near its boiling point at the first stage, and maintains high solvent recovery by further cooling the uncondensed vapors to a lower temperature at the second stage.

In one aspect, a process for recovering solvent from spent oil sand solids is provided, comprising:

drying the solids using superheated steam to vaporize solvent and water;

compressing the vapors, and condensing the vapors at a high pressure in a hot side of a first heat exchanger to produce condensates, comprising primarily condensed hot water and solvent and uncondensed vapors;

separating hot water near its boiling point and recovered solvent from the uncondensed vapors in a first separator;

lowering the pressure and then flowing the hot water through a cold side of the first heat exchanger to produce near-saturated steam;

superheating the near-saturated steam in a second heat exchanger to produce the superheated steam for drying;

further condensing the vapors from the first separator in a third heat exchanger to produce warm water, solvent and uncondensed off gas;

separating warm water and recovered solvent from the off gas in a second separator; and combining a portion of the warm water after pressure let-down with the hot water to produce near-saturated steam.

BRIEF DESCRIPTION OF THE DRAWINGS

Referring to the drawings wherein like reference numerals indicate similar parts throughout the several views, several aspects of the present invention are illustrated by way of example, and not by way of limitation, in detail in the figures, wherein.

DETAILED DESCRIPTION OF THE PREFERRED EMBODIMENTS

The detailed description set forth below in connection with the appended drawings is intended as a description of various embodiments of the present invention and is not intended to represent the only embodiments contemplated by the inventor. The detailed description includes specific details for the purpose of providing a comprehensive understanding of the present invention. However, it will be apparent to those skilled in the art that the present invention may be practiced without these specific details.

The present invention relates generally to a process of recovering solvent from spent oil sand solids using superheated steam. The invention is particularly useful for recovering solvent having five to seven carbon atoms per molecule or mixtures thereof including, but not limited to, pentane, hexane and heptane.

Figure 1:
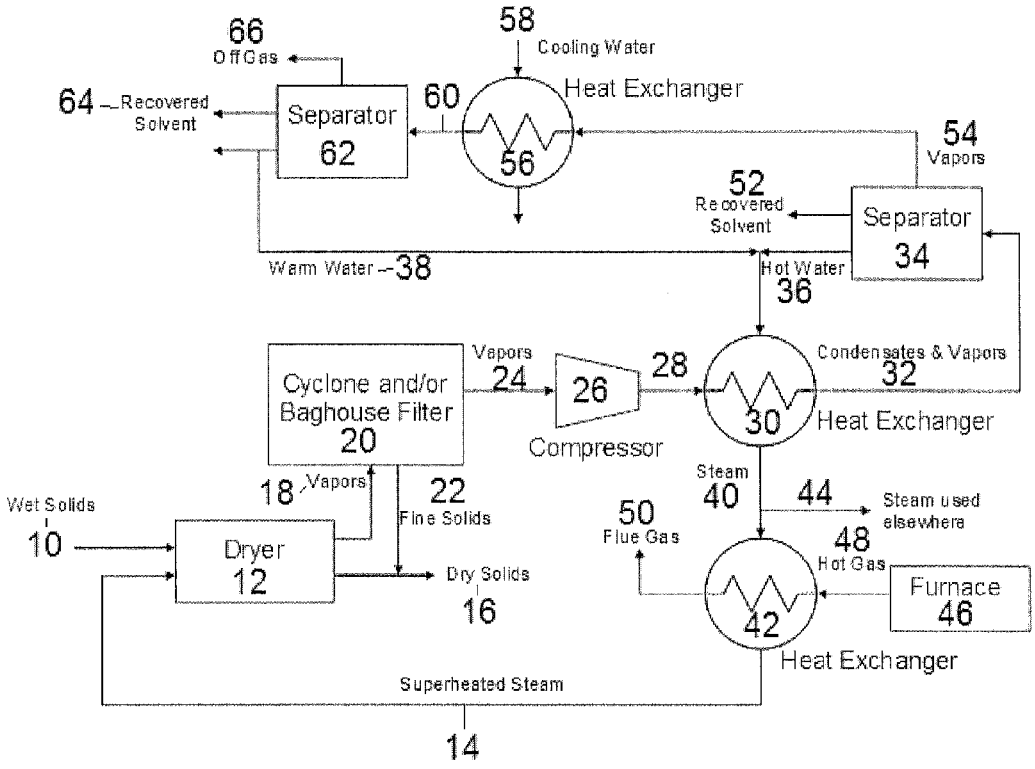
FIG. 1 is a schematic of one embodiment of the present invention for recovering solvent from spent oil sands solids.

FIG. 1 is a flow diagram of the process of the present invention. The conduits among the various components may be constructed from any suitable piping as is employed in the art. Suitable piping includes, without limitation, plastic piping, galvanized metal piping, and stainless steel piping. In one embodiment, the conduit may comprise a screw conveyor or auger conveyor.

Wet spent oil sand solids 10 are fed into a dryer 12. In one embodiment, the dryer 12 is a direct dryer comprising a horizontal rotary drum having flights for lifting and cascading down solids. The heat for the dryer 12 is provided by superheated steam 14. As used herein, the term "superheated steam" means steam at a temperature higher than water's boiling point at the same pressure. In one embodiment, the temperature of the superheated steam 14 ranges from 400° C. to 800° C. In one embodiment, the pressure of the superheated steam 14 fed to the dryer 12 is near or at ambient pressure. In one embodiment, the pressure in the vapor space of the dryer 12 is slightly below ambient pressure to prevent leakage of solvent vapor from the dryer 12. The steam flow rate is set to a value which does not cause excessive dust carryover and premature solids removal prior to sufficient drying. Variation in feed moisture content is handled by adjusting the temperature of the superheated steam 14 to maintain the temperature of the exiting vapors 18 above 100° C. In one embodiment, the temperature of the vapors 18 is about 120° C.

Upon exiting the dryer 12, the dry solids 16 have a temperature of about 100° C. The dryer 12 allows high solids throughput. In one embodiment, a dryer 12 having a rotary drum with a diameter of about 10 m may process spent oil sand solids at a rate of 1800 t/h. The length of the drum depends upon the residence time required to dry the solids to a moisture level of about 0.5 wt % to about 2.0 wt % and a solvent level of about 0 mg/kg to about 400 mg/kg at the maximum moisture load. Because of better heat exchanging efficiency, the drum length of the superheated steam dryer is shorter than that of a large indirect rotary kiln which dries the same solids at a throughput of less than about 900 t/h.

The vapors 18 exit the dryer 12 through an insulated duct and are cleaned through a cyclone, baghouse, or both 20. The cyclone 20 creates a vortex to separate any fine solids 22 from the vapors 18. The baghouse 20 is a collector in which fine solids 22 are removed from the vapors 18 by passing the vapors 18 through a fabric filter. The fine solids 22 are discharged and combined with the dry solids 16 for transport to a disposal site. The dry solids 16 may be suitably treated to form trafficable solids before disposal (see for example, United States Patent Application Publication No. 2012/0048782 to Wu et al.).

The filtered vapors 24 enter a compressor 26 which increases the pressure of the vapors 24 by reducing the volume. The compression ratio is in the range of about 1.3 to about 2.5. In one embodiment, the compression ratio is about 1.8, making the dewpoint of the compressed vapors 28 about 115° C. The compressed vapors 28 enter a first heat exchanger 30. The first heat exchanger 30 and all heat exchangers described herein may comprise any suitable single heat exchanger or multiple-stage heat exchangers and may be constructed from any suitable materials including copper and aluminum. The compressed vapors 28 enter through the hot side of the first heat exchanger 30 for cooling and condensation. As used herein, the term "condensation" means the change of the physical state of matter from the gaseous phase into the liquid phase, and is the reverse of vaporization. Condensation occurs when a vapor is cooled and/or compressed to its saturation limit when the molecular density in the gas phase reaches its maximal threshold.

The condensates 32 comprising water and uncondensed vapors are then transferred from the first heat exchanger 30 to a first separator 34. In one embodiment, the first separator 34 comprises a 3-phase separator. As used herein, the term "3-phase separator" means a vessel capable of separating water, liquid hydrocarbon, and gases in a process stream. The 3-phase separator may be horizontal or vertical.

Hot water 36 having a temperature ranging from 90° C. to 100° C. exits the first separator 34, and combines with warm water 68. The water streams undergo pressure reduction and the combined stream 38 enters through the cold side of the first heat exchanger 30. The water pressure in the conduit 38 is about one atmosphere. In one embodiment, the warm water 38 has a temperature of about 60° C. The combined water boils at about 100° C. to form near-saturated steam 40. As used herein, "saturated steam" means steam which is in equilibrium with heated water at the same pressure, i.e., it has not been heated past the boiling point for that pressure.

A portion of the near-saturated steam 40 is diverted via conduit 44 for use in other processes such as, for example, solvent or water-based extraction. The majority of steam 40 enters a second heat exchanger 42 via conduit 74 for superheating. A furnace 46 generates a hot combustion gas stream 48 which enters the second heat exchanger 42 to superheat the steam 74. The cooled flue gas 50 exits the second heat exchanger 42. The superheated steam 14 generated in the second heat exchanger 42 is directed to the dryer 12. In one embodiment, the second heat exchanger 42 is built within the furnace 46.

Figure 2:
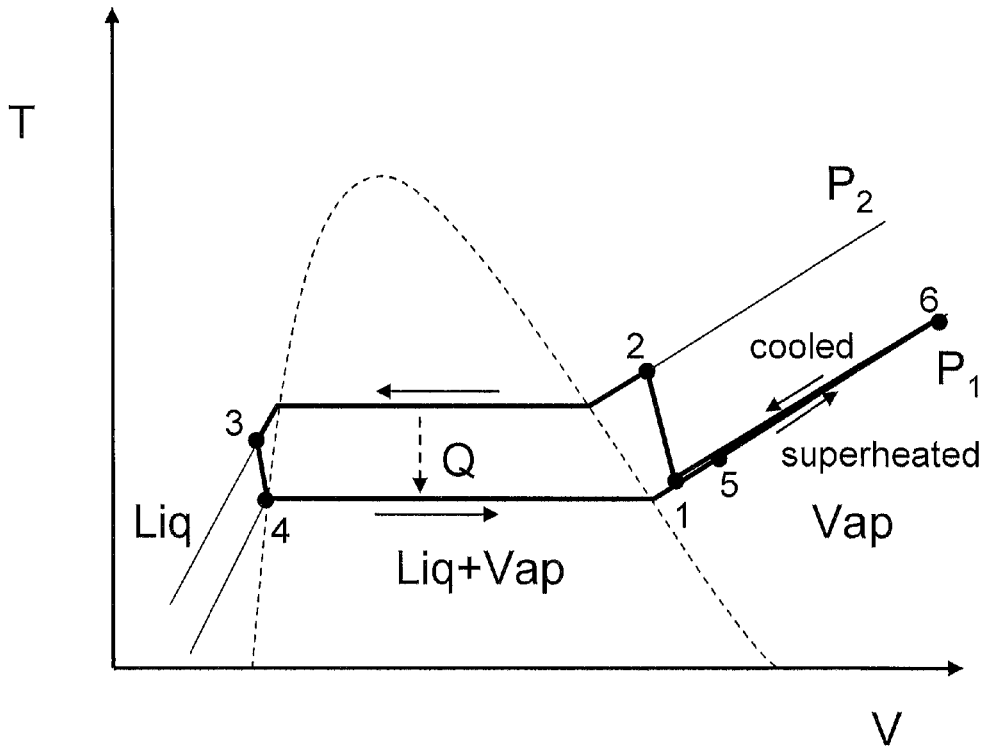
FIG. 2 is a graph showing a diagram of temperature (T)–molar volume (V) for water/steam as heating medium, with the phase of water changes from liquid (Liq) to liquid+vapor (Liq+Vap) to vapor (Vap) following a line of constant pressure (P) from left to right. For the two pressures, $P_2$ is greater than $P_1$. Each number represents one state of water during the process shown in FIG. 1 as indicated: 1. near-saturated steam after being used in drying (stream 18 or 24); 2, compressed steam (stream 28); 3. condensed water at a higher pressure, $P_2$ (stream 32); 4. condensed water near the ambient pressure, $P_1$ (stream 38); 5, near-saturated steam (stream 40); 6. superheated steam (stream 14). Heat, Q, is transferred from the high-pressure system to the low-pressure system through heat exchanging.

The compressor 26, first heat exchanger 30, and first separator 34 together form a quasi-closed-loop system of mechanical vapor recompression (MVR). After being used for drying, the superheated steam 14 undergoes compression, condensation, decompression, re-vaporization, and superheating (FIG. 2; 1>2>3>>4>5>6>1). The process separates the solvent 52 from the hot water 36 prior to superheating. The standard MVR for a water evaporator is an open system without connecting point 4 (saline water feed) and point 3 (distilled water product). In other superheated steam drying applications, the MVR process is used to recover the latent heat of the additional steam produced in the dryer and superheat the recycled vapors (see for example, Kudra et al., 2009). In contrast, the present invention does not recycle vapors for superheating due to safety and reliability concerns.

The first separator 34 also generates recovered solvent 52 and vapors 54 under an elevated pressure. In one embodiment, the pressure of vapors 54 is about 1.6 atmospheres. The vapors 54 enter a third heat exchanger 56 for cooling and condensation mediated by cooling water 58 which flows through the third heat exchanger 56. The cooled stream 60 flows into a second separator 62. In one embodiment, the cooled stream 60 has a temperature of about 60° C. In one embodiment, the second separator 62 comprises a 3-phase separator. The second separator 62 separates warm water, recovered solvent 64, and off gas 66 from the cooled stream 60. A portion of the warm water 68 combines with the hot water 36 to produce the near-saturated steam 40 for superheating. The remainder of the warm water 70 is disposed or recycled in other processes such as, for example solvent or water-based extraction. The temperature for cooled stream 60 may be lower if more volatile hydrocarbon solvents are present. The off gas 66 may be scrubbed in an oil scrubber to further remove solvent vapor before being released to the atmosphere or being combusted. Alternately, the off gas 66 may be combusted without oil scrubbing.

The first separator 34 produces primarily condensed water, while the second separator 62 primarily produces condensed solvent. The "two-stage" cooling and condensation process involving use of the first heat exchanger 30, the first separator 34, the third heat exchanger 56, and the second separator 62 conserves energy by recycling the hot water 36 near its boiling point, while maintaining high solvent recovery by cooling the vapors 54 to a lower temperature in the second heat exchanger 56. In one embodiment, the solvent recovery in the process is above 98%.

Exemplary embodiments of the present invention are described in the following Examples, which are set forth to aid in the understanding of the invention, and should not be construed to limit in any way the scope of the invention as defined in the claims which follow thereafter.

Example 1

The process shown in FIG. 1 was simulated using Aspen HYSYS v2006 (AspenTech, Burlington, Mass.). A wet solids feed of 1800 metric tonnes per hour (t/h) at 40° C. was applied in the simulation. The wet solids contained 6 wt % water (108 t/h) and 7 wt % solvent (126 t/h). The solvent was pure n-heptane ($C_7$). It was assumed that 72 t/h water and 126 t/h solvent were vaporized in the dryer. The exit vapor temperature was 120° C. The exit solids and residual water temperatures were both 100° C. A rotary dryer of 10 m in diameter was assumed. The velocity of the vapor stream flowing through the cross-section of the dryer was maintained at 2.24 m/s. The air leak and/or nitrogen purge rate into the dryer was assumed to be 1.8 t/h. Table 1 sets out the simulation results (i.e., component mass flow rates and other parameters of various process streams).

TABLE 1

| Stream No. | Description | $H_2O$ rate (t/h) | $C_7$ Rate (t/h) | T (° C.) | P (kPa abs.) |
|---|---|---|---|---|---|
| 10 | Wet solids feed of 1800 t/h | 108 | 126 | 40 | 95 |
| 14 | Superheated steam | 240 | 0 | 773 | 95 |
| 18 | Vapors from dryer | 312 | 126 | 120 | 95 |
| 28 | Compressed vapors | 312 | 126 | 177 | 171 |
| 36 | $1^{st}$-stage condensed water | 271 | 0 | 99 | 166 |
| 52 | $1^{st}$-stage condensed solvent | 0 | 0 | — | — |
| 54 | $1^{st}$-stage vapors | 41 | 126 | 99 | 161 |
| 68 | $2^{nd}$-stage condensed water 1 | 20 | 0 | 60 | 141 |
| 70 | $2^{nd}$-stage condensed water 2 | 20 | 0 | 60 | 141 |
| 64 | $2^{nd}$-stage condensed solvent | 0 | 124 | 60 | 141 |
| 58 | Cooling water in | 1014 | 0 | 25 | 150 |
| 72 | Cooling water out | 1014 | 0 | 60 | 140 |
| 38 | Combined water for steam generation | 291 | 0 | 97 | 112 |
| 74 | Steam to be superheated for drying | 240 | 0 | 134 | 102 |
| 44 | Steam to be used elsewhere | 51 | 0 | 134 | 102 |
| 48 | Combustion gas (from natural gas at 7.5 t/h) | ~16 | 0 | 1810 | 115 |
| 50 | Flue gas | ~16 | 0 | 248 | 105 |

The solvent recovery from the vapor stream by condensation alone was 98.7%. With an addition of an oil scrubber for the off-gas (stream 66), the solvent recovery from the vapor stream approached 100%. The main solvent loss was the loss through dry solids. Assuming the upper limit of the solvent concentration in the dry solids as 400 mg/kg, the solvent recovery was 99.5%.

From the foregoing description, one skilled in the art can easily ascertain the essential characteristics of this invention, and without departing from the spirit and scope thereof, can make various changes and modifications of the invention to adapt it to various usages and conditions. Thus, the present invention is not intended to be limited to the embodiments shown herein, but is to be accorded the full scope consistent with the claims, wherein reference to an element in the singular, such as by use of the article "a" or "an" is not intended to mean "one and only one" unless specifically so stated, but rather "one or more". All structural and functional equivalents to the elements of the various embodiments described throughout the disclosure that are known or later come to be known to those of ordinary skill in the art are intended to be encompassed by the elements of the claims. Moreover, nothing disclosed herein is intended to be dedicated to the public regardless of whether such disclosure is explicitly recited in the claims.

REFERENCES

The following references are incorporated herein by reference (where permitted) as if reproduced in their entirety. All references are indicative of the level of skill of those skilled in the art to which this invention pertains.

Adeyinka, O.; Speirs, B. C.; Esmaeili, P.; Pierre, F. Jr.; Rhodes, A.; Glanz, W. and Myers, R. D. Processes and systems for solvent extraction of bitumen from oil sands. Canadian Patent Application No. 2,724,806, published Jun. 30, 2011.

Blackbourn, R. L.; Batt, R. A.; Giles, S. P.; Komishke, B. D.; Long, Y.; Ploemen, I. H. J. and In't Veen, B. C. M. Closed loop solvent extraction process for oil sands. Canadian Patent Application No. 2,715,301, published Mar. 23, 2011.

Friedman, R. H. and Eakin, B. Process for extracting hydrocarbons from hydrocarbon bearing ores. U.S. Pat. No. 4,571,294, issued Feb. 18, 1986.

Friedman, R. H. and Eakin, B. Extraction process and apparatus for hydrocarbon containing ores. U.S. Pat. No. 4,539,093, issued Sep. 3, 1985.

Funk, E. W. and May, W. G. Solvent extraction process for tar sands. U.S. Pat. No. 4,347,118, issued Aug. 31, 1982.

Gable, C. M.; Duncan, E. A. Jr. and Freitas, E. R. Selective solvent extraction plus filtration of tar sands. U.S. Pat. No. 3,475,318, issued Oct. 28, 1969.

Govier, G. W. Volatile liquid recovery process. Canadian Patent Application No. 2,012,563, published Sep. 20, 1991.

Graham, R. J. and Helstrom, J. J. Method for solvent treating of tar sands with water displacement. U.S. Pat. No. 4,722,782, issued Feb. 2, 1988.

Guymon, E. P. Solvent and water/surfactant process for removal of bitumen from tar sands contaminated with clay. U.S. Pat. No. 4,968,412, issued Nov. 6, 1990.

Hanson, D. O. and Sherk, F. T. Solvent extraction of tar sand. U.S. Pat. No. 4,139,450, issued Feb. 13, 1979.

Hastings, L. W. Apparatus for extracting bitumen from tar sand. U.S. Pat. No. 4,311,561, issued Jan. 19, 1982.

Johnson, S. W. and Smith, R. H. Process for separating crude oil from mixtures comprising finely divided inorganic solids, crude oil, and water. U.S. Pat. No. 4,460,452, issued Jul. 17, 1984.

Karnofsky, G. B. Apparatus for the continuous solvent extraction of bitumen from oil-bearing sand. U.S. Pat. No. 4,422,901, issued Dec. 27, 1983.

Karnofsky, G B. Process for the solvent extraction of bitumen from oil sand. U.S. Pat. No. 4,448,667, issued May 15, 1984.

Kudra, T. and Mujumdar, A. S. (2009) "Chap 7. Superheated Steam Drying", *Advanced Drying Technologies,* $2^{nd}$ edition, CRC Press.

Mitchell, D. S. Solvent extraction process. U.S. Pat. No. 4,189,376, issued Feb. 19, 1980.

Monceaux, D. A. and Kuehner, D. (2009) "Chapter 21. Dry-house Technologies and DDGS Production", *The Alcohol Textbook,* $5^{th}$ edition, W. M. Ingledew (ed), Nottingham University Press.

Peuker, U. Methods and devices for extracting hydrocarbons from oil sand. Canadian Patent Application No. 2,734,067, published Sep. 17, 2011.

Rosenbloom, W. J. Method and apparatus for the solvent extraction of oil from bitumen containing tar sand. U.S. Pat. No. 5,534,136, issued Jul. 9, 1996.

Ryu, H. System for separating bitumen from oil sands, United States Patent Application No. 2009/0294332, published Dec. 3, 2009.

Sparks, B. D. and Meadus, F. W. Solvent extraction spherical agglomeration of oil sands. U.S. Pat. No. 4,719,008, issued Jan. 12, 1988.

Williams, M. A. (2005) "Chapter 3. Recovery of Oils and Fats from Oilseeds and Fatty Materials", *Bailey's Industrial Oil and Fat Products,* $6^{th}$ edition, Vol. 5 Edible Oil and Fat Products: Processing Technologies, F. Shahidi (ed), Wiley-Interscience.

Wu, X. A.; Jones, G. B. and Cymerman, G. Extraction of oil sand bitumen with two solvents. United States Patent Application Publication No. 2012/0048782, published Mar. 1, 2012.

We claim:

1. A process for recovering solvent from spent oil sand solids comprising:

a) drying the solids using superheated steam to vaporize solvent and water;

b) compressing the vapors, and condensing the vapors in a hot side of a first heat exchanger to produce condensates comprising condensed hot water and solvent and uncondensed vapors;

c) separating hot water and recovered solvent from the uncondensed vapors produced in step (b) in a first separator;

d) flowing the hot water through a cold side of the first heat exchanger to produce near-saturated steam;

e) superheating the near-saturated steam in a second heat exchanger to produce the superheated steam of step (a);

f) further condensing the vapors from step (c) in a third heat exchanger to produce warm water and solvent and uncondensed off gas;

g) separating warm water and recovered solvent from the uncondensed off gas produced in step (f) in a second separator; and h) combining a portion of the warm water with the hot water in step (d).

2. The process of claim 1, further comprising:

i) scrubbing the uncondensed off gas from the second separator with an oil scrubber or combusting the off gas prior to release to the atmosphere.

3. The process of claim 1, wherein the temperature of the superheated steam ranges from 400° C. to 800° C.

4. The process of claim 3, wherein the superheated steam has a pressure near or at ambient pressure.

5. The process of claim 1, wherein drying is conducted in a direct dryer comprising a horizontal rotary drum.

6. The process of claim 5, wherein the dried solids have a moisture content ranging from about 0.5 wt % to about 2.0 wt % and a solvent concentration ranging from about 0 mg/kg to about 400 mg/kg.

7. The process of claim 1, wherein before compression, the vapors are filtered to remove fine solids.

8. The process of claim 7, wherein the vapors have a temperature above about 100° C.

9. The process of claim 1, wherein the vapors are compressed at a compression ratio in the range of about 1.3 to about 2.5.

10. The process of claim 1, wherein the hot water has a temperature ranging from about 90° C. to about 100° C.

11. The process of claim 10, wherein the hot water undergoes pressure reduction to near ambient pressure prior to being heat exchanged to produce near-saturated steam.

12. The process of claim 1, wherein the warm water has a temperature of about 60° C. or below.

13. The process of claim 1, further comprising flowing combustion gas from a furnace through the second heat exchanger.

14. The process of claim 1, wherein the off gas from the second separator is scrubbed in an oil scrubber and/or combusted.

15. The process of claim 1, wherein solvent recovery from the solids is about 98% or greater.

16. The process of claim 1, wherein the first and second separators comprise 3-phase separators.

* * * * *